US011421684B2

(12) United States Patent
Franzoni et al.

(10) Patent No.: US 11,421,684 B2
(45) Date of Patent: Aug. 23, 2022

(54) DEVICE FOR PROVIDING A FLOW AND A METHOD OF VARYING A FLOW RATE

(71) Applicant: Dana Motion Systems Italia S.R.L., Reggio Emilia (IT)

(72) Inventors: Federica Franzoni, Reggio Emilia (IT); Alessandro Sassi, Reggio Emilia (IT)

(73) Assignee: Dana Motion Systems Italia S.r.l., Reggio Emilia (IT)

( * ) Notice: Subject to any disclaimer, the term of this patent is extended or adjusted under 35 U.S.C. 154(b) by 0 days.

(21) Appl. No.: 17/226,136

(22) Filed: Apr. 9, 2021

(65) Prior Publication Data

US 2021/0324852 A1 Oct. 21, 2021

(30) Foreign Application Priority Data

Apr. 17, 2020 (DE) ..... 10 2020 204 911.4

(51) Int. Cl.

| | |
|---|---|
| ***F04C 2/08*** | (2006.01) |
| ***F04C 14/00*** | (2006.01) |
| ***F04C 14/08*** | (2006.01) |
| ***F04C 15/06*** | (2006.01) |
| ***F04C 2/14*** | (2006.01) |

(52) U.S. Cl.

CPC ..... *F04C 2/084* (2013.01); *F04C 2/14* (2013.01); *F04C 14/00* (2013.01); *F04C 14/08* (2013.01); *F04C 15/06* (2013.01); *F04C 2240/30* (2013.01); *F04C 2240/60* (2013.01)

(58) Field of Classification Search

CPC .... F04C 2/084; F04C 2/14–20; F04C 18/084; F04C 18/14–20; F04C 2240/30; F01C 1/084; F01C 1/14–20

See application file for complete search history.

(56) References Cited

U.S. PATENT DOCUMENTS

| | | | |
|---|---|---|---|
| 8,235,961 | B2 | 8/2012 | Nakaoka |
| 10,072,676 | B2 | 9/2018 | Afshari |
| 10,138,908 | B2 | 11/2018 | Vacca |
| 2009/0088280 | A1 | 4/2009 | Warren |
| 2014/0056732 | A1 | 2/2014 | Wang |
| 2018/0223839 | A1 | 8/2018 | Jang |

FOREIGN PATENT DOCUMENTS

| | | | |
|---|---|---|---|
| CN | 112761942 | A * | 5/2021 |
| JP | H0942165 | A * | 2/1997 |

* cited by examiner

*Primary Examiner* — Laert Dounis

(74) *Attorney, Agent, or Firm* — Marshall & Melhorn, LLC

(57) ABSTRACT

The gear pump may have a casing, a main shaft and rotating means connected to one end of the main shaft and configured to rotate the main shaft. Housed by the casing, a toothed wheel and at least one other toothed element are intermeshed with the toothed wheel. The other end of the main shaft is connected to one of the toothed wheel and the casing. Rotating the main shaft relative to the rotating means rotates the toothed wheel and the at least one other toothed element relative to the casing, thereby generating the flow. The other one of the casing and the toothed wheel is configured to be rotated around an axis defined by the main shaft for varying a flow rate of the generated flow.

7 Claims, 5 Drawing Sheets

DEVICE FOR PROVIDING A FLOW AND A METHOD OF VARYING A FLOW RATE

TECHNICAL FIELD

The present invention relates to the technical field of devices for providing a flow and in particular relates to gear pumps.

BACKGROUND

A gear pump uses a meshing of gears to generate a flow. A gear pump may for instance comprise a casing, wherein the casing houses a pump chamber and two or three toothed elements intermeshed for forming the gears. One of the toothed elements is a toothed wheel which is mounted on, or close to, one end of a main shaft. This toothed wheel comprises teeth extending outward from the wheel. The main shaft has the other end extending out of the casing. A rotating means, e.g. a motor, is connected to the other end for rotating the main shaft with respect to the rotating means. Driving the rotating means then generates the flow. A flow rate of the flow is determined by the rotation frequency of the main shaft and a hydraulic displacement, which is defined as the volume of fluid pumped per revolution of the main shaft.

The other toothed element, or elements, may also be a wheel, or wheels, with teeth extending outward. In this case, the gear pump is an external gear pump, and each of the other toothed wheel or wheels is mounted on a respective additional shaft. Alternatively, the other toothed element is formed as a ring having teeth extending inward. In this case, the gear pump is an internal gear pump.

A flow rate can be controlled by controlling the rotational speed of the rotating means.

US 2018/223839 A1 describes a variable displacement pump with a fixed gear, a movable gear, a fixed gear ring fitted over the movable gear, a movable gear ring fitted over the fixed gear, a fixed cover having a hole in which the fixed gear ring rotates, a movable cover having a hole in which the movable gear ring rotates, a fixed gear block attached to the fixed cover, and a movable gear block attached to the movable cover. The movable gear, together with the movable cover, the movable gear, and the movable gear block, move along the direction of the shaft to change a width in which the fixed gear is engaged with the movable gear.

US 2009/088280 A1 relates to a variable displacement gear pump device in a housing that provides variable hydraulic displacement without diverting pressurized fluid back to the pump inlet. A variable-speed pump is known from U.S. Pat. No. 10,072,676 B2. The pump comprises a proportional control valve assembly, and an actuator for controlling a load. A controller establishes a speed and/or torque of the pump and a position of the proportional control valve assembly. Further prior art useful for understanding the background of the present invention is disclosed in U.S. Pat. No. 10,138,908 B1 and US 2014/056,732 A1.

SUMMARY

Embodiments of the present invention concern a device and a method according to the independent claims for enabling a fast variation of a flow rate without affecting a rotation speed of a main shaft. Further embodiments of the invention are specified in the dependent claims. Subsequently described aspects are to be considered embodiments of the invention if and only if they fall in the scope of any of the independent claims.

According to an aspect, a device for providing a flow rate comprises a gear pump. The gear pump comprises a casing and a main shaft. One end of the main shaft is configured to be drivingly connected to a rotating means. The gear pump further comprises, housed by the casing, a toothed wheel and at least one other toothed element intermeshed with the toothed wheel. The other end of the main shaft is connected to one of the toothed wheel and the casing. The main shaft is configured to be rotated with respect to the rotating means around an axis defined by the main shaft for rotating the toothed wheel and the at least one other toothed element relative to the casing for generating a flow. The other one of the casing and the toothed wheel not connected to the main shaft is configured to be rotated with respect to the rotating means around the axis defined by the main shaft for varying a flow rate of the generated flow.

In this aspect, the main shaft can be rotated at constant speed, and the generated flow rate can still be varied by rotating the other one of the casing and the toothed wheel not connected to the main shaft.

The toothed wheel may be mounted on the one end of the main shaft. A further toothed wheel may be mounted on a further shaft and have outward extending teeth. In this case, an outer surface of the casing may comprise outward extending teeth intermeshed with the teeth of the further toothed wheel.

Alternatively, the further shaft may be connected to the other one of the casing and the toothed wheel not connected to the main shaft. The further shaft then may be aligned with the main shaft. The further shaft then may extend opposite to the main shaft.

The device may further comprise controlling means and energy recuperation means. The energy recuperation means may be connected to the further shaft for recuperating energy from a rotation of the other one of the casing and the toothed wheel not connected to the main shaft. The controlling means may then be configured to: control an amount of energy recuperated by the energy recuperation means for varying the flow rate. Optionally, the controlling means may be configured to: receive a control signal for varying the flow rate and control an amount of energy recuperated accordingly.

The device may comprise an outer casing housing the casing, and the casing can be rotated with respect to the outer casing. In this case, an end of the further shaft may extend out of the outer casing.

An inlet and an outlet may be provided in the outer casing. Two parallel circumferential notches may be provided in a circular cylindrical surface of the casing. Two radially extending tubular channels may be formed in the casing, additionally. The radially extending channels may extend in opposite directions and may be connected to the two parallel circumferential notches. A circumferential sealing may be provided between the notches, and a pair of further circumferential sealings may enclose the notches. The notches, together with the outer casing, the sealing and the further sealings, may form tubular channels. Then, one of the notches is in fluid connection with the inlet and the other of the notches is in fluid connection with the outlet.

According to another aspect, a method for using the device comprises: Rotating the main shaft relative to the rotating means for rotating the toothed wheel and the at least one other toothed element with respect to the rotating means around the axis defined by the main shaft to the casing for generating a flow, and rotating the other one of the casing and the toothed wheel not connected to the main shaft with respect to the rotating means around the axis defined by the main shaft for varying a flow rate of the generated flow.

The method may comprise using the controlling means for controlling the amount of energy recuperated by the energy recuperation means for varying the flow rate.

The present invention provides a device configured for a quickly variable flow rate which is simple in its design and cheap to manufacture.

DESCRIPTION OF THE DRAWINGS

In the following, the present invention is explained by means of exemplary embodiments showed in the attached figures and drawings, in which.

DETAILED DESCRIPTION

The present invention is defined by the independent claims. In the following description, reference is made to the accompanying drawings, which form part of the disclosure and in which are shown, by way of illustration, exemplary aspects by which the present invention may be realized. It is understood that other aspects may be utilized and structural or logical changes may be made without departing from the scope of the appended claims. The following detailed description, therefore, is not to be considered to limit the present invention.

Figure 1:
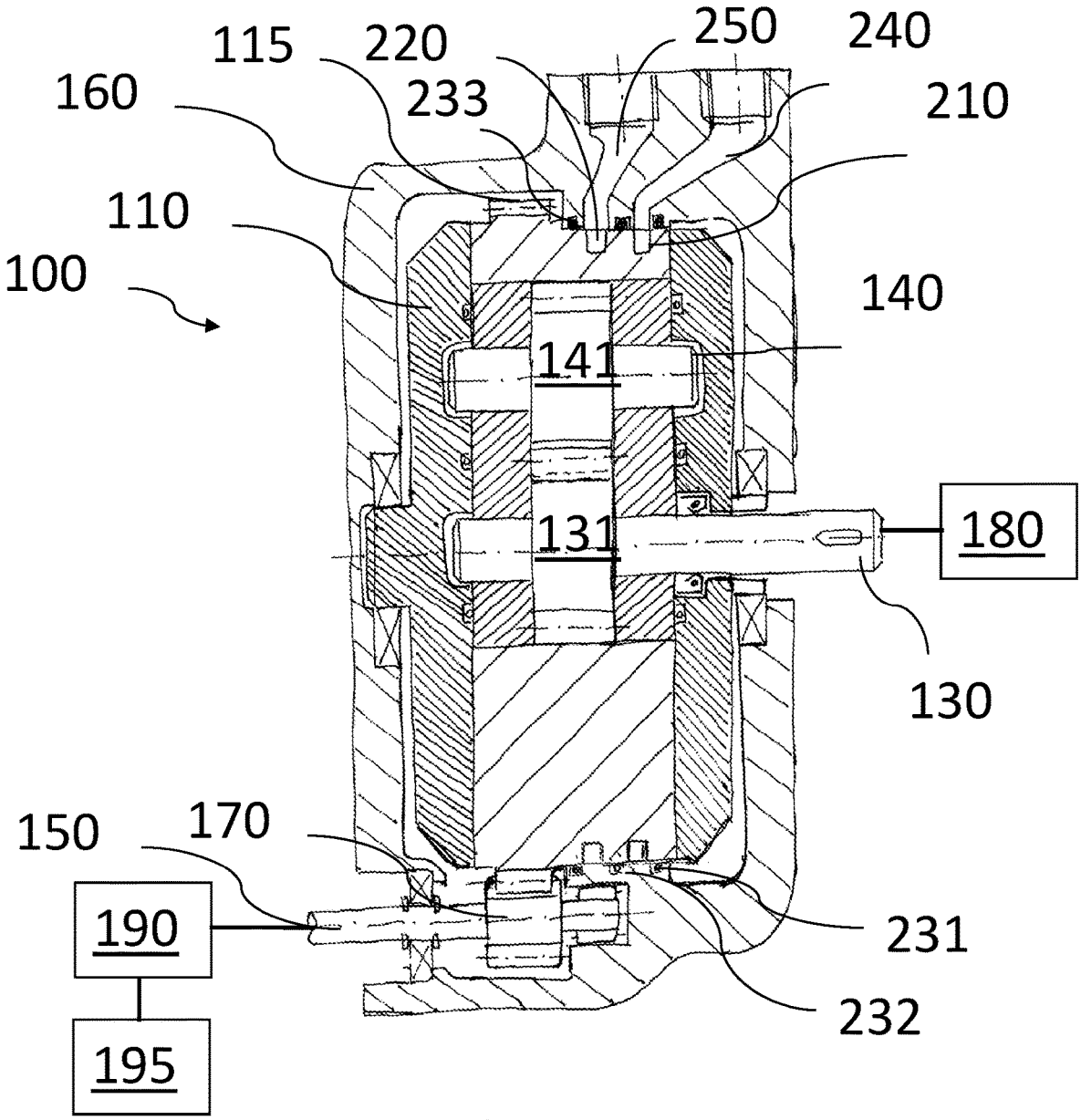
FIG. 1 shows an exemplary embodiment of a device according to the present invention.
Figure 2:
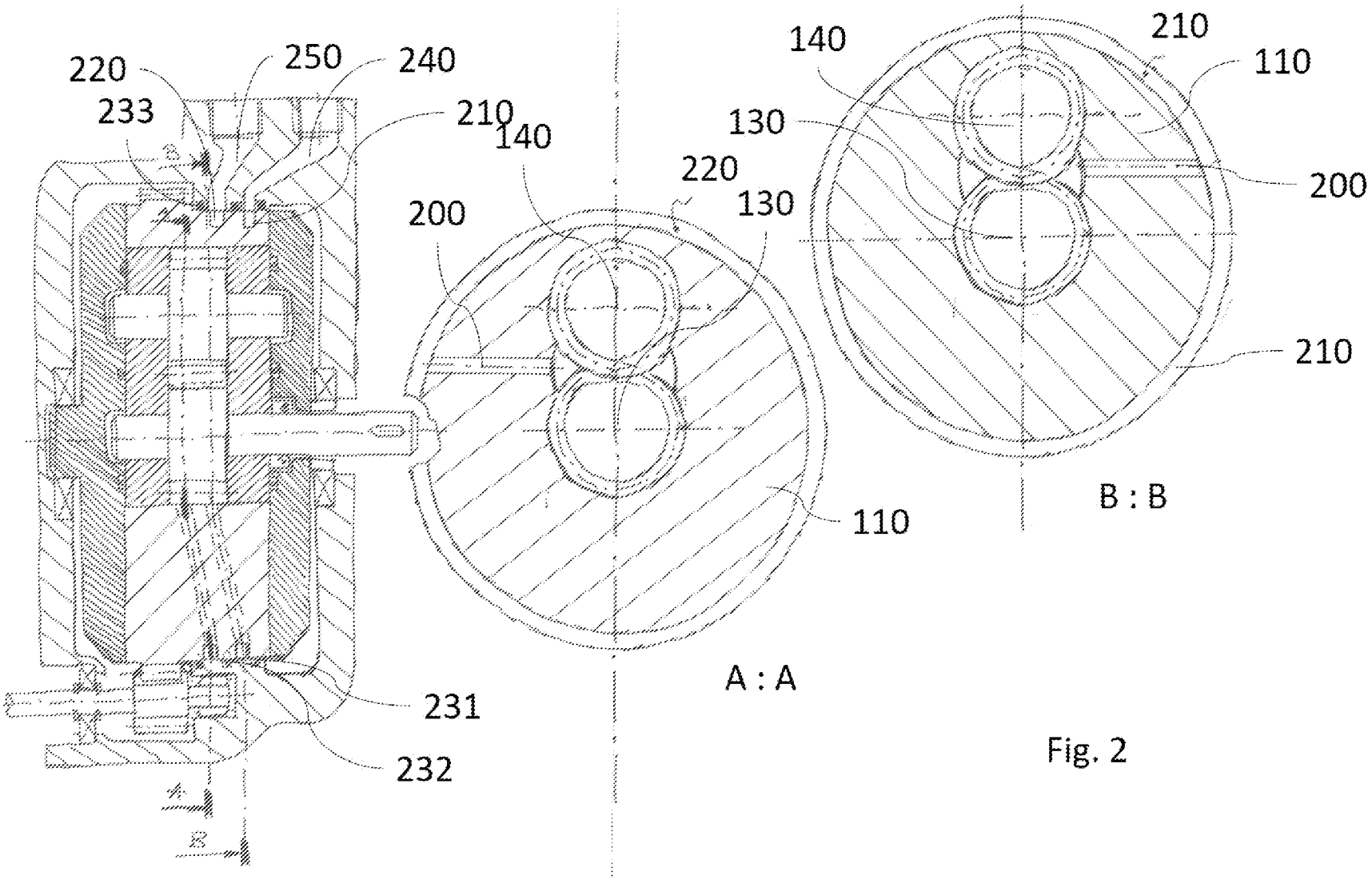
FIG. 2 shows the exemplary embodiment from a different perspective.

FIGS. 1 and 2 show an exemplary embodiment of a device 100 according to the present invention.

The device 100 is configured for variable flow rate and comprises a gear pump. The gear pump exemplarily comprises a casing 110 with an inlet 240 for a fluid to be pumped and an outlet 250 for the pumped fluid and a main shaft 130. The main shaft 130 has one end extending out of the casing 110, for instance through an opening provided in a sidewall of the casing 110. A toothed wheel 131 with outwardly extending teeth is mounted on the main shaft 130 on, or close to, the other end of the main shaft. The toothed wheel 131 is housed by the casing 110 encapsulated in a pump chamber of the gear pump. The casing 110 further houses another toothed element intermeshed with the toothed wheel 131, for instance an other toothed wheel 141, encapsulated in the pump chamber.

In the embodiment shown, the other toothed wheel 141 has teeth extending outward and is mounted on an additional shaft 140 which extends parallel to the main shaft 130. However, the other toothed element may be formed as a ring or a belt having teeth extending inward. In this case, the one of the toothed wheels is located inside the ring or inside the belt and the other toothed element is not necessarily mounted on any shaft.

The main shaft is configured for being drivingly connected to a rotating means or component 180, for instance a motor. A flow through the casing from the inlet to the outlet can be generated by rotation of the main shaft. A flow rate of the flow is defined by a rotation frequency of the main shaft and a hydraulic displacement of the gear pump. The hydraulic displacement corresponds to the volume pumped per revolution of the main shaft.

A further toothed wheel 170 is mounted on or close to one end of a further shaft 150. The casing 110 is formed with teeth 115 extending from the circular cylindrical surface. The teeth 115 extending from the circular cylindrical surface of the casing 110 are intermeshed with the teeth of the further toothed wheel 170.

By rotating the further shaft 150, the casing 110 can be rotated around an axis defined by the main shaft 130 with respect to the rotating component 180. Likewise, the further shaft 150 can be rotated by rotating the casing 110 around the main shaft 130. Then, energy can be recuperated from the further shaft 150. By controlling the amount of energy recuperated from the further shaft, the flow rate can be controlled and varied.

An outer casing 160 houses the casing 110. The further toothed wheel 170 is encapsulated by the outer casing 160, and the other end of the further shaft 150 extends out of the outer casing 160. By rotating the casing 110 relative to the rotating component 180 connected to the main shaft, the further shaft 150 is rotated relative to the rotating component 180 and, hence, relative to the outer casing 160. Rotating the further shaft 150 relative to the rotating component 180 causes the casing 110 to be rotated relative to the rotating component 180 and relative to the outer casing 160.

A gear ratio between the further toothed wheel 170 and the casing 110 may be i.

Figure 3:
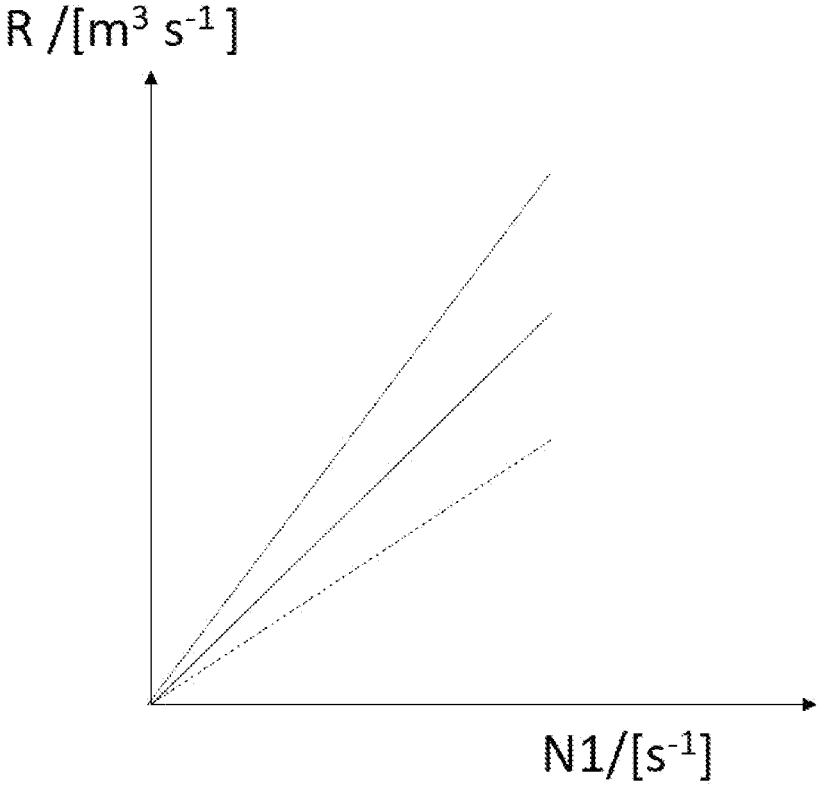
FIG. 3 shows relationships between a flow rate and a rotation frequency of a main shaft for different rotation frequencies of a further shaft according to the exemplary embodiment.

If the main shaft rotates at a frequency N1>0 with respect to the rotating component 180 and the further shaft does not rotate with respect to the rotating component 180, the relationship between the flow rate R, measured in $m^3 \cdot s^{-1}$, and N1, measured in $s^{-1}$, may be represented by the bold line in FIG. 3.

If, however, the further shaft rotates with respect to the rotating component 180 at a frequency N2>0 in the same direction of rotation of the main shaft with respect to the rotating means 180, in the embodiment of FIG. 1 and FIG. 2 the flow rate corresponds to rotation of the main shaft at N1+N2/i with respect to the rotating component 180, and the relationship between the flow rate R and N1 may be represented by the dotted line in FIG. 3.

If the further shaft rotates at a frequency N3>0 in the opposite direction to the main shaft, the flow rate corresponds to rotation of the main shaft at N1−N3/i. In this case, the relationship between the flow rate R and N1 may be represented by the dashed line in FIG. 3. Particularly, no flow occurs if the further shaft rotates in the opposite direction to the main shaft with i-times the frequency at which the main shaft rotates: N3=i*N1.

When the further shaft rotates in the opposite direction to the main shaft, it may be driven by the casing, and energy can be recuperated from the other end of the further shaft, for instance by connecting it to a motor-generator such as a dynamo.

By controlling a rate of energy recuperated from the further shaft, a flow rate of the flow generated by the main shaft may be controlled.

More generally speaking, energy recuperation means or component 190 may be connected to the further shaft and may be configured to recuperate energy from rotation of the further shaft for varying a displacement generated by rotation of the main shaft. A controlling means or controller 195 is configured to control an amount of energy recuperated by the energy recuperation component 190 for varying the flow rate.

There are two pump supply lines, one for supplying the fluid to be pumped and one for diverting the pumped fluid. Each of the pump supply lines comprises a radially extending tubular channel 200 in the casing 110. The radially extending channels 200 extend from the pump chamber in opposite directions and connect the pump chamber with two parallel circumferential, or annular, notches 210, 220 in the circular cylindrical surface of the casing 110. Corresponding to the notches 210, 220 in the casing 110, there is a circumferential, or annular, sealing 232 between the notches 210, 220.

Furthermore, a pair of further circumferential sealings 231, 233 enclose the notches 210, 220. Alternatively, the sealings may be provided in the outer casing 160. The notches 210, 220, together with the outer casing 160 and the sealings 231, 232, 233, form tubular channels. Each of the circumferential notches 210, 220 is in fluid connection with a corresponding inlet 240 or outlet 250 of the gear pump formed in the outer casing 160. There may be corresponding notches in the outer casing which correspond to the notches in the casing and are in fluid connection with the inlet or outlet.

Figure 4:
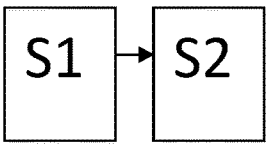
FIG. 4 shows an exemplary embodiment of a method according to the present invention.

FIG. 4 shows an exemplary embodiment of a method according to the present invention. The method is configured for varying the flow rate of a device according to the present invention.

The method showed in FIG. 4 comprises a step S1 of using the rotating component 180 for rotating the main shaft with respect to the rotating component 180 for generating a flow through the device and a step of rotating the casing around an axis defined by the main shaft with respect to the rotating component 180 for varying a flow rate of the generated flow.

The method may comprise generating a flow through the device with a predetermined flow rate and reducing the flow rate of the generated flow to a target flow rate, for instance by recuperating energy from a rotation of the further shaft, for instance by means of a dynamo.

Figure 5:
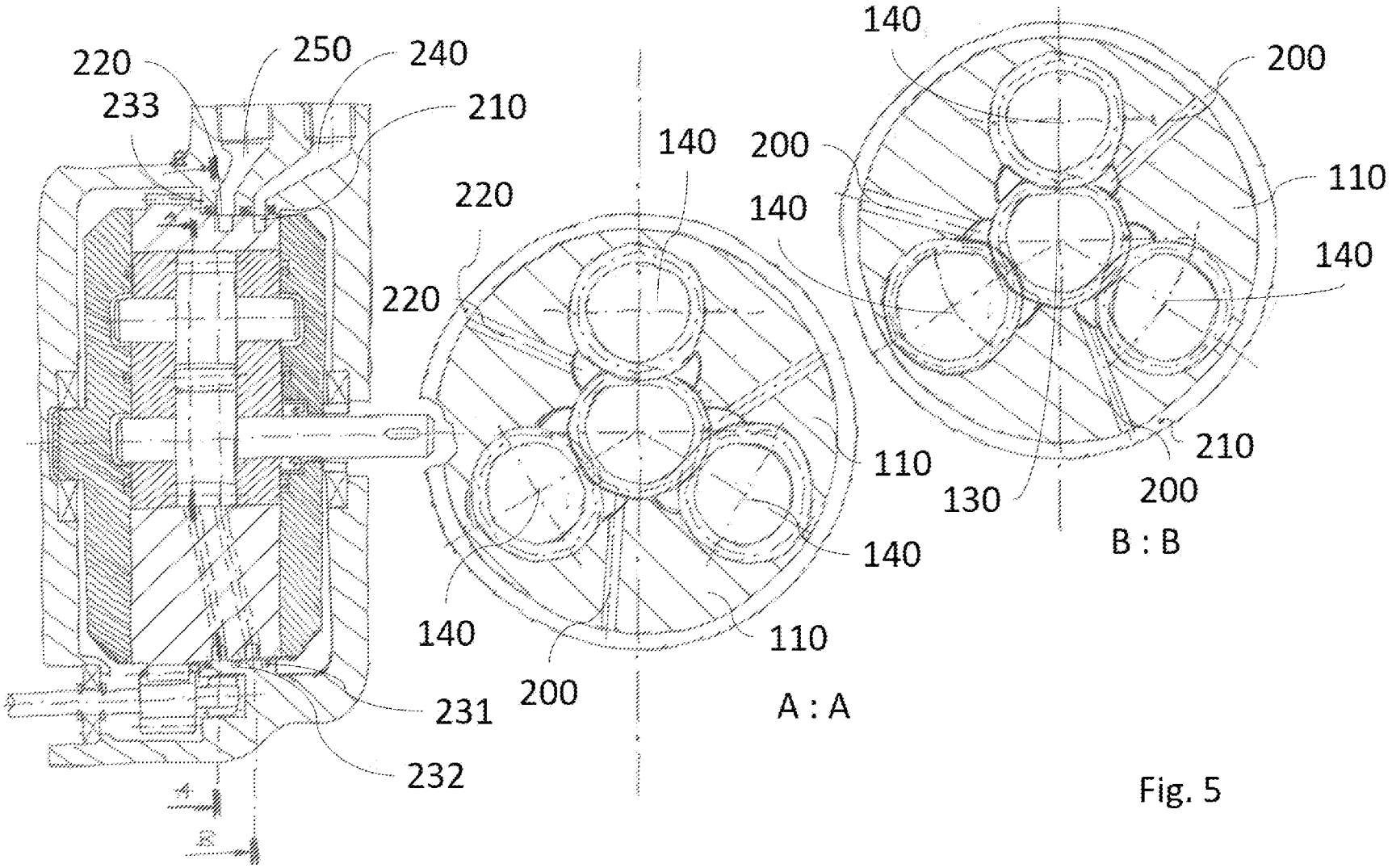
FIG. 5 shows a further exemplary embodiment of a device according to the present invention.

FIG. 5 shows a further exemplary connection of pump supply lines to a device according to the present invention. In this further exemplary embodiment, the device comprises a toothed wheel 130 on the main shaft and three further toothed wheels 140. There are two pump supply lines 240, 250, one for supplying the fluid to be pumped and one for diverting the pumped fluid. Each of the pump supply lines comprises three radially extending tubular channels 200 in the casing 110. The radially extending tubular channels 200 in the casing connect the pump chamber in the casing with a respective circumferential notch 210, 220 in the circular cylindrical surface of the casing 110.

Figure 6:
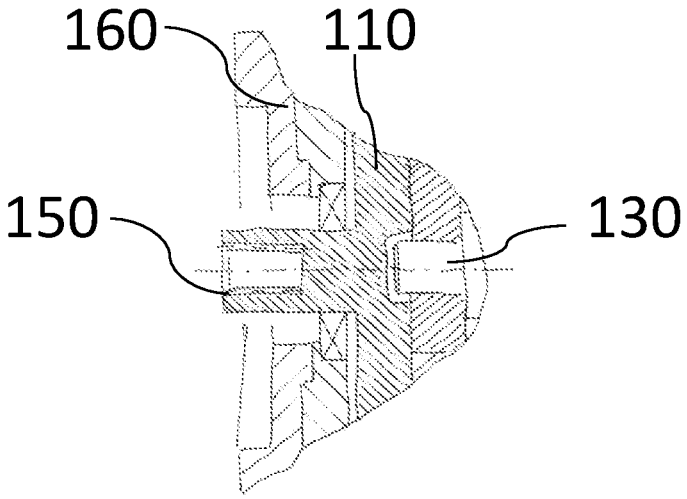
FIG. 6 shows an even further exemplary embodiment of a device according to the present invention.

FIG. 6 shows a further optional aspect of the device. In FIG. 6, the further shaft 150 is connected to the casing 110. The further shaft 150 is aligned with the main shaft 130. The further shaft 150 extends opposite to the main shaft 130 and it is connected to the casing 110. In this way the further shaft 150 has a speed equal to the speed of the casing 110.

Figure 7:
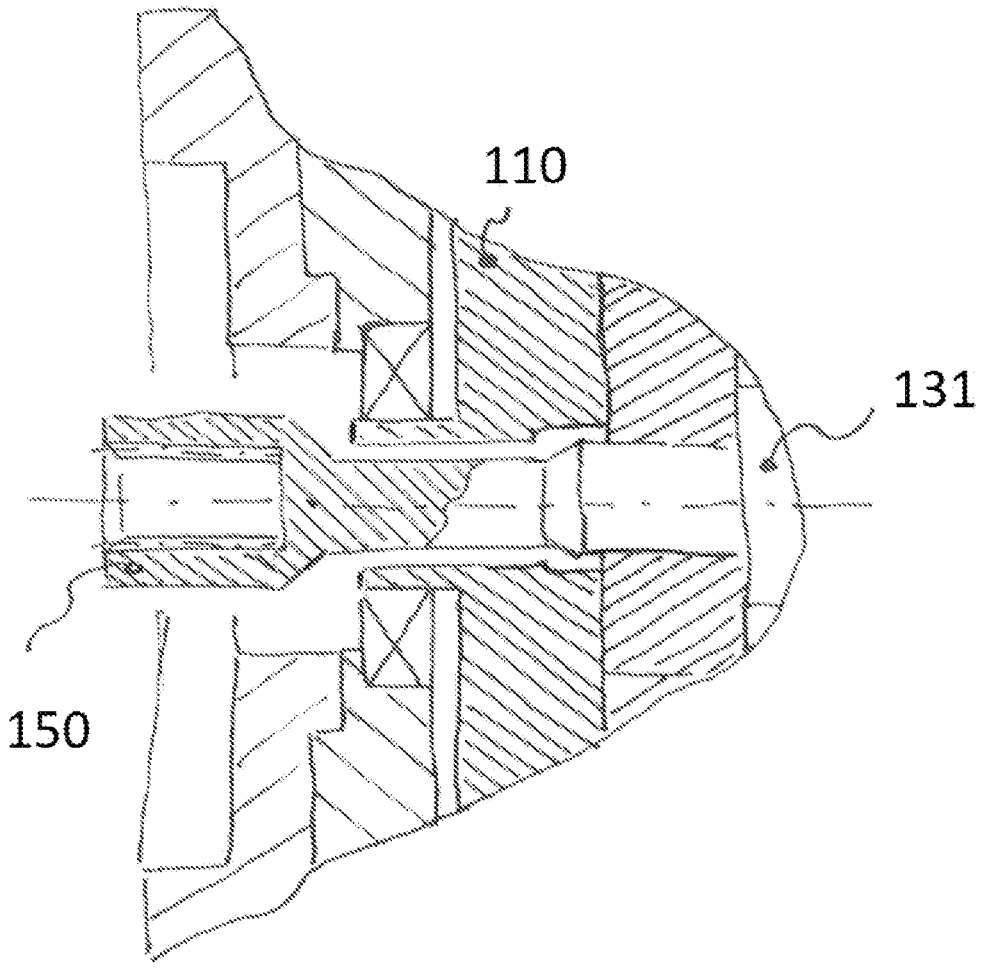
FIG. 7 shows a yet further exemplary embodiment of a device according to the present invention.

FIG. 7 shows a yet further optional aspect of the device. As in FIG. 6, further shaft 150 extends opposite to the main shaft 130 and is aligned with the main shaft. In FIG. 7, the main shaft 130 is, however, connected to the casing 110 and the further shaft 150 is connected to the toothed wheel 131. In this way the further shaft 150 has a speed equal to the speed of the toothed wheel 131.

In FIGS. 6 and 7, the casing needs not to be formed with teeth extending from the circular cylindrical surface, and the further toothed wheel can be omitted.

REFERENCE SIGN LIST 100 device for generating a flow rate
110 casing
115 outer surface of the casing formed as a yet further toothed wheel
130 main shaft
140 additional shaft
131, 141 toothed wheels
150 further shaft
160 further casing
170 yet further toothed wheel
180 rotating means
190 rotating and/or energy recuperation means
195 controlling means
200 radially extending tube in the casing
210, 220 notches in the casing
231, 232, 233 sealings
240, 250 inlet and outlet in the outer casing

What is claimed is:

1. A device for providing a flow, comprising:
a gear pump comprising a casing,
a main shaft, wherein a first end of the main shaft is configured to be drivingly connected to a rotating component, and,
the casing housing a toothed wheel and at least one other toothed element intermeshed with the toothed wheel,
wherein a second end of the main shaft is connected to the toothed wheel and the casing,
wherein the main shaft is configured to be rotated with respect to the rotating component around an axis defined by the main shaft for rotating the toothed wheel and the at least one other toothed element relative to the casing for generating a flow, wherein
wherein the casing is configured to be rotated with respect to the rotating component around the axis defined by the main shaft for varying a flow rate of the generated flow,
wherein a first end of a further shaft is connected to the casing and a further toothed wheel, and
wherein the further shaft is aligned with the main shaft and extends opposite to the main shaft.

2. The device according to claim 1, wherein the toothed wheel is mounted on the second end of the main shaft, wherein the
further toothed wheel mounted on the first end of the further shaft has outwardly extending teeth;
wherein the further shaft extends parallel to the main shaft, and
wherein an outer surface of the casing comprises outward extending teeth intermeshed with the teeth of the further toothed wheel.

3. The device according to claim 1, further comprising a controller and an energy recuperation component, wherein the energy recuperation component is connected to a second end of the further shaft for recuperating energy from a rotation of the casing and the toothed wheel or from the at least one other toothed element, respectively, and wherein the controller is configured to control an amount of energy recuperated by the energy recuperation component for varying the flow rate.

4. The device according to claim 3, further comprising an outer casing housing the casing;

wherein the casing can be rotated with respect to the outer casing.

5. The device according to claim 4, wherein the second end of the further shaft extends out of the outer casing.

6. The device according to claim 5, further comprising:

an inlet and an outlet provided in the outer casing;

two parallel circumferential notches in a circular cylindrical surface of the casing, two radially extending tubular channels in the casing, wherein the radially extending channels extend in opposite directions and are connected to the two parallel circumferential notches;

a circumferential sealing between the notches, and a pair of further circumferential sealings enclosing the notches, wherein the notches, together with the outer casing, the sealing and the further sealings, form tubular channels and one of the notches is in fluid connection with the inlet and the other of the notches is in fluid connection with outlet.

7. A method for using a device for providing a flow, comprising:

providing a main shaft having a first end connected to a rotating component and a second end connected to a toothed wheel, a casing housing the toothed wheel and at least one other toothed element, a further shaft connected to the casing, and a controller and an energy recuperation component, wherein the energy recuperation component is connected to the further shaft for recuperating energy from a rotation of the casing and the toothed wheel or from the at least one other toothed element, respectively, and wherein the controller is configured to control an amount of energy recuperated by the energy recuperation component for varying the flow rate, rotating the main shaft relative to the rotating component for rotating the toothed wheel and the at least one other toothed element with respect to the rotating component around an axis defined by the main shaft to the casing for generating a flow, and rotating the casing and a further toothed wheel not connected to the main shaft with respect to the rotating component around the axis defined by the main shaft for varying a flow rate of the generated flow, using the controller for controlling the amount of energy recuperated by the energy recuperation component for varying the flow rate.

* * * * *